US007892057B1

(12) United States Patent
Belter

(10) Patent No.: US 7,892,057 B1
(45) Date of Patent: Feb. 22, 2011

(54) OUTBOARD MOTOR WITH IDLE RELIEF VALVE

(75) Inventor: David J. Belter, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 402 days.

(21) Appl. No.: 12/119,876

(22) Filed: May 13, 2008

(51) Int. Cl.
*B63H 21/34* (2006.01)

(52) U.S. Cl. ..... 440/89 G

(58) Field of Classification Search ..... 440/88 G, 440/89 G

See application file for complete search history.

(56) References Cited

U.S. PATENT DOCUMENTS 3,552,121 A * 1/1971 Kitagawa et al. ..... 60/310
3,943,876 A * 3/1976 Kiekhaefer ..... 440/43
4,601,666 A * 7/1986 Wood, Jr. ..... 440/89 R
4,668,199 A 5/1987 Freund et al.
4,986,780 A * 1/1991 Sougawa ..... 440/89 R
5,041,036 A 8/1991 Clark et al.
5,118,316 A * 6/1992 Kakizaki et al. ..... 440/89 R
5,348,500 A 9/1994 Lassanske
5,524,578 A 6/1996 Craft et al.
6,151,892 A * 11/2000 Brewer et al. ..... 60/313
7,001,231 B1 2/2006 Halley et al.

* cited by examiner

*Primary Examiner*—Stephen Avila
(74) *Attorney, Agent, or Firm*—William D. Lanyi

(57) ABSTRACT

An idle exhaust relief passage is provided with a valve that can inhibit flow through the passage in response to certain operating conditions of an engine of an outboard motor. More particularly, operation above a predetermined threshold can be used to inhibit flow through the idle exhaust relief passage. A valve, configured for this purpose, can be a flapper valve.

18 Claims, 2 Drawing Sheets

OUTBOARD MOTOR WITH IDLE RELIEF VALVE

BACKGROUND OF THE INVENTION

1. Field of the Invention

The present invention is generally related to an outboard motor with an idle relief conduit and, more particularly, to an outboard motor with an idle relief system that is selectively controlled as a function of an operating condition of the engine, such as its operating speed.

2. Description of the Related Art

Those skilled in the art of outboard motor design and manufacture are very familiar with the concept relating to an idle relief conduit. Typically, a primary exhaust path discharges exhaust from an engine to a location below the surface of a body of water. This is done for several reasons, including noise reduction, which are very familiar to those skilled in the art. Many types of outboard motors also include an idle relief system that allows exhaust to be emitted above the surface of the body of water. The purpose of the idle relief system is to allow exhaust to be emitted, when the engine is operating at idle speed, without causing the engine to labor unnecessarily to force the exhaust to overcome the pressure caused by standing water within the outboard motor through which the exhaust gas must pass in order to be emitted below the surface of a body of water. Those skilled in the art of marine propulsion systems are very well aware of many different types of systems that accomplish these purposes.

U.S. Pat. No. 4,668,199, which issued to Freund et al. on May 26, 1987, discloses an idle exhaust relief system for outboard motors. It includes a main exhaust passageway extending through a partially filled water chamber in the driveshaft housing. An inlet idle relief passage connects the top of the chamber with the main exhaust passageway and an outlet passage connects the top of the chamber with the atmosphere. The system defines an effective exhaust silencer for the idle exhaust.

U.S. Pat. No. 5,041,036, which issued to Clark et al. on Aug. 20, 1991, describes an idle exhaust gas relief arrangement for an outboard motor. The outboard motor comprises an internal combustion engine including a lower surface having therein an exhaust gas discharge port, a driveshaft housing having an upper end including an upper face fixed to the lower surface of the internal combustion engine, an outer surface extending downwardly from the upper face, an interior vertically extending main exhaust gas passage extending from the upper face and communicating with the exhaust gas discharge port, and an idle exhaust gas relief passage recessed in the upper face and in spaced relation to the main exhaust gas passage.

U.S. Pat. No. 5,348,500, which issued to Lassanske on Sep. 20, 1994, describes a marine propulsion device with selectively operable secondary exhaust discharge. It comprises a powerhead including an internal combustion engine having an output shaft and an exhaust port, a propeller shaft adapted to hold the propeller, a selective coupler of the engine output shaft and a propeller shaft, an exhaust passage communicating with the engine exhaust port and comprising a first exhaust outlet and a second exhaust outlet, and a valve that is associated with the selective coupler to open and close the second exhaust outlet.

U.S. Pat. No. 5,524,578, which issued to Craft et al. on Jun. 11, 1996, describes a two-cycle engine having an improved idle relief system. The engine has an engine block defining at least two cylinders having respective cylinder heads. Pistons are reciprocal within respective ones of the cylinders. The cylinders have respective fuel inlet ports and exhaust ports and two of the cylinders have an idle relief port disposed between their respective exhaust port and head ends.

U.S. Pat. No. 7,001,231, which issued to Halley et al. on Feb. 21, 2006, discloses a dual water injector for primary and idle relief exhaust passages. A water cooling system for an outboard motor provides a water conduit that extends through both an idle exhaust relief passage and a primary exhaust passage. Water within the water conduit flows through first and second openings to distribute sprays or streams of water into first and second exhaust conduits which can be the primary and idle exhaust relief passages of an outboard motor.

The patents described above are hereby expressly incorporated by reference in the description of the present invention.

The flow of exhaust gas through an idle exhaust relief conduit can emit noise, particularly when the engine is operated at relatively high speed. When a marine vessel is operating at elevated speeds, above idle speed, many types of engines continue to conduct exhaust gas through the idle exhaust relief conduit even though the engine is no longer operating at idle speed. This emission of exhaust through the idle relief conduit is above the surface of the body of water on which the marine vessel is operated and, therefore, is not muffled by being emitted below the surface. As a result, noise emission from the idle exhaust relief conduit can diminish the enjoyment of the use of the marine vessel. Some outboard motors provide silencers in conjunction with the idle exhaust relief conduit. However, it would be significantly beneficial if a system could be provided which inhibits the flow of exhaust gas through the idle exhaust relief conduit when the engine of an outboard motor is operated above a preselected level, such as idle speed.

SUMMARY OF THE INVENTION

An outboard motor made in accordance with a preferred embodiment of the present invention, comprises an engine, a primary exhaust path connected in fluid communication with the engine, a secondary exhaust path connected in fluid communication with the engine, and a valve configured to inhibit the flow of exhaust gas through the secondary exhaust path in response to a preselected operating condition of the engine.

In a particularly preferred embodiment of the present invention, the secondary exhaust path is connected in fluid communication with the primary exhaust path at a connection point. A water injector is connected in fluid communication with the primary exhaust path, in a preferred embodiment of the present invention, at a location upstream from the connection point. The valve is disposed between the connection point and a point of the secondary exhaust path which is at atmospheric pressure, such as its outlet to the atmosphere. In certain embodiments of the present invention, it can further comprise an adapter plate disposed beneath the engine. The valve can be disposed within the adapter plate. In a preferred embodiment of the present invention, the valve is a flapper valve. The preselected operating condition of the engine can be its operating speed or, in certain embodiments, the pressure of exhaust gas within the secondary exhaust path.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
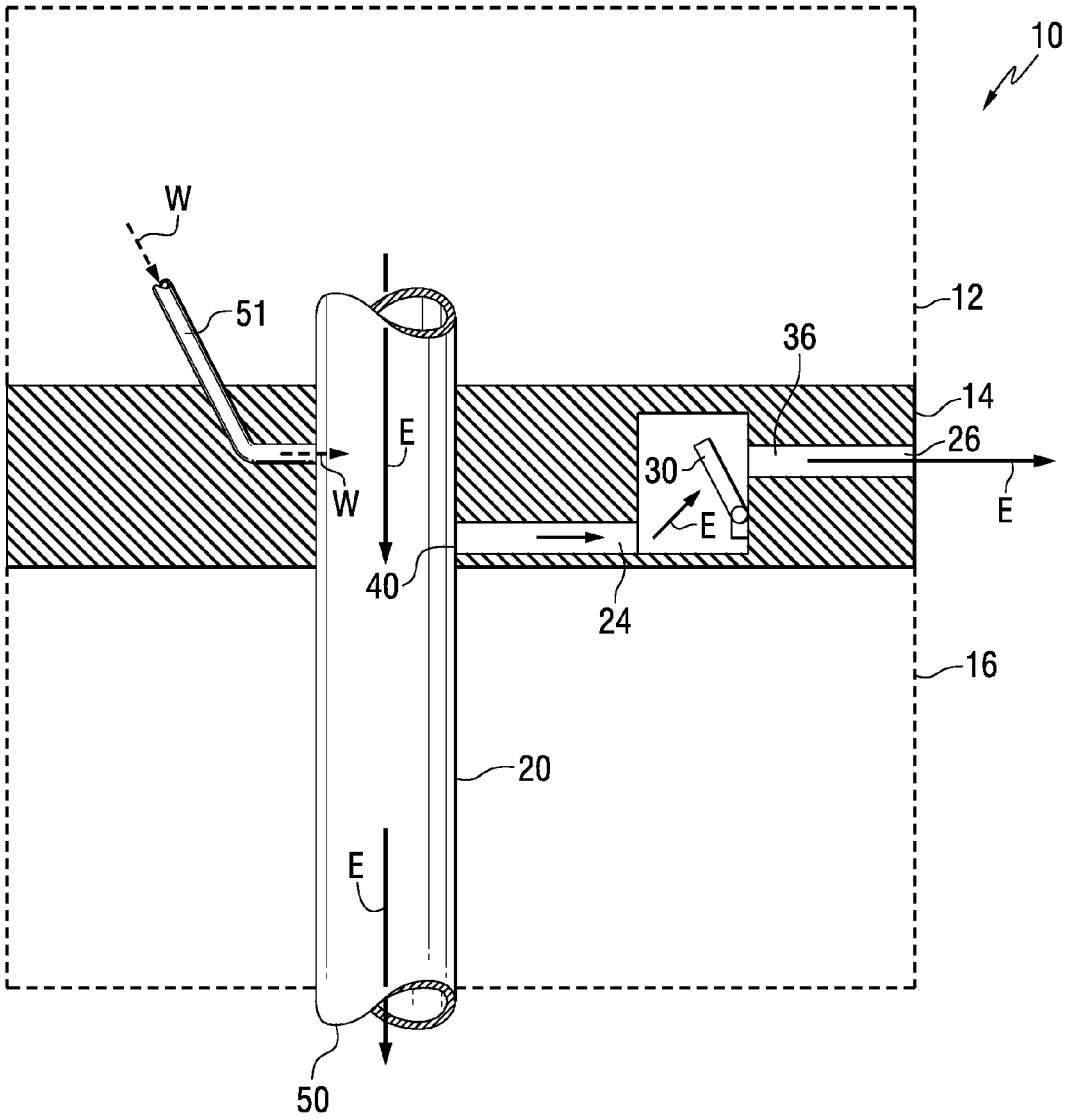
FIG. 1 is a schematic representation of an engine, a driveshaft housing, an adapter plate, and an idle exhaust relief passage made in accordance with a preferred embodiment of the present invention.

Throughout the description of the preferred embodiment of the present invention, like components will be identified by like reference numerals.

Those skilled in the art of marine propulsion systems are generally aware of devices that close a secondary, or idle exhaust relief, exhaust outlet when the marine propulsion device is shifted into forward gear. This type of device is described in U.S. Pat. No. 5,348,500 which is identified above. One problem that exists in systems like that described in the Lassanske patent is that the secondary, or idle relief, exhaust conduit, is closed without regard to engine speed as long as the manual control handle is in a forward gear position. Devices of that type respond to the transmission position of the marine propulsion device and not to the speed of the engine. As a result, the idle exhaust relief conduit will not conduct exhaust gas if the transmission is in forward gear even though the engine may continue to operate at idle speed or slightly above. As will be described in greater detail below, preferred embodiments of the present invention do not respond to gear position but, instead, respond directly to the speed (i.e. operating condition) of the engine. In addition, preferred embodiments of the present invention are not dependent on operator interaction (e.g. moving a throttle handle). Instead, preferred embodiments of the present invention respond to the actual pressure within the exhaust conduits that result from the operating speed of the engine. The simplest embodiment of the present invention, as will be described below, is a flapper valve which is moved into a closed position when exhaust pressure increases above a predetermined magnitude. The closed position, as described below, inhibits the flow of exhaust gas through the secondary, or idle exhaust relief, outlet. In alternative embodiments of the present invention, a microprocessor can be provided to actuate a valve when the engine is operating at a speed above a predetermined threshold. It is important to note that, unlike the Lassanske patent described above, the preferred embodiments of the present invention do not react to the gear position of the marine propulsion device. Instead, they respond to the operating speed of the engine, as indicated by the increased exhaust gas pressure within the primary and secondary exhaust conduits in a preferred embodiment.

FIG. 1 is a schematic representation of an outboard motor 10 which has an engine 12 disposed directly above an adapter plate 14 with a driveshaft housing 16 suspended below the adapter plate 14. The illustration in FIG. 1 is intentionally simplified in a highly schematic manner in order to more clearly illustrate the basic concepts of the present invention. Exhaust gas E is typically directed to flow from the engine 12, through the adapter plate 14, and downwardly through the driveshaft housing 16 through an exhaust conduit 20. In certain outboard motors, water W is introduced into the exhaust conduit 20 in order to reduce the temperature of the exhaust gases flowing away from the engine 12. In a manner that is very well known to those skilled in the art of marine propulsion systems, the exhaust gas E is directed to flow to a primary outlet 50 that is located below the surface of the body of water in which the marine propulsion system is operating. Typically, this exhaust passage causes the exhaust gas to flow through a propeller (not shown in FIG. 1) and be emitted into the body of water.

A portion of the exhaust gas E is directed through an idle exhaust relief conduit 24 to be emitted through an outlet 26 to the atmosphere. This allows exhaust gas to be emitted by the outboard motor when the engine 12 is operating at idle speed. Without an idle exhaust relief passage 24, the engine would have to create sufficient pressure to overcome the hydrostatic pressure caused by the fact that the primary exhaust outlet is below the surface of the body of water.

The present invention provides a valve 30 that is configured to inhibit the flow of exhaust gas E through the idle exhaust relief path. The embodiment shown in FIG. 1 uses a flapper valve that allows passage of exhaust gases to the atmosphere when the engine is operating at sufficiently low speeds to produce pressure within the secondary path, or idle exhaust relief path 24, which is not sufficiently high to force the flapper valve 30 into a blocking position with regard to conduit 36 which is part of the idle exhaust relief passage.

Figure 2:
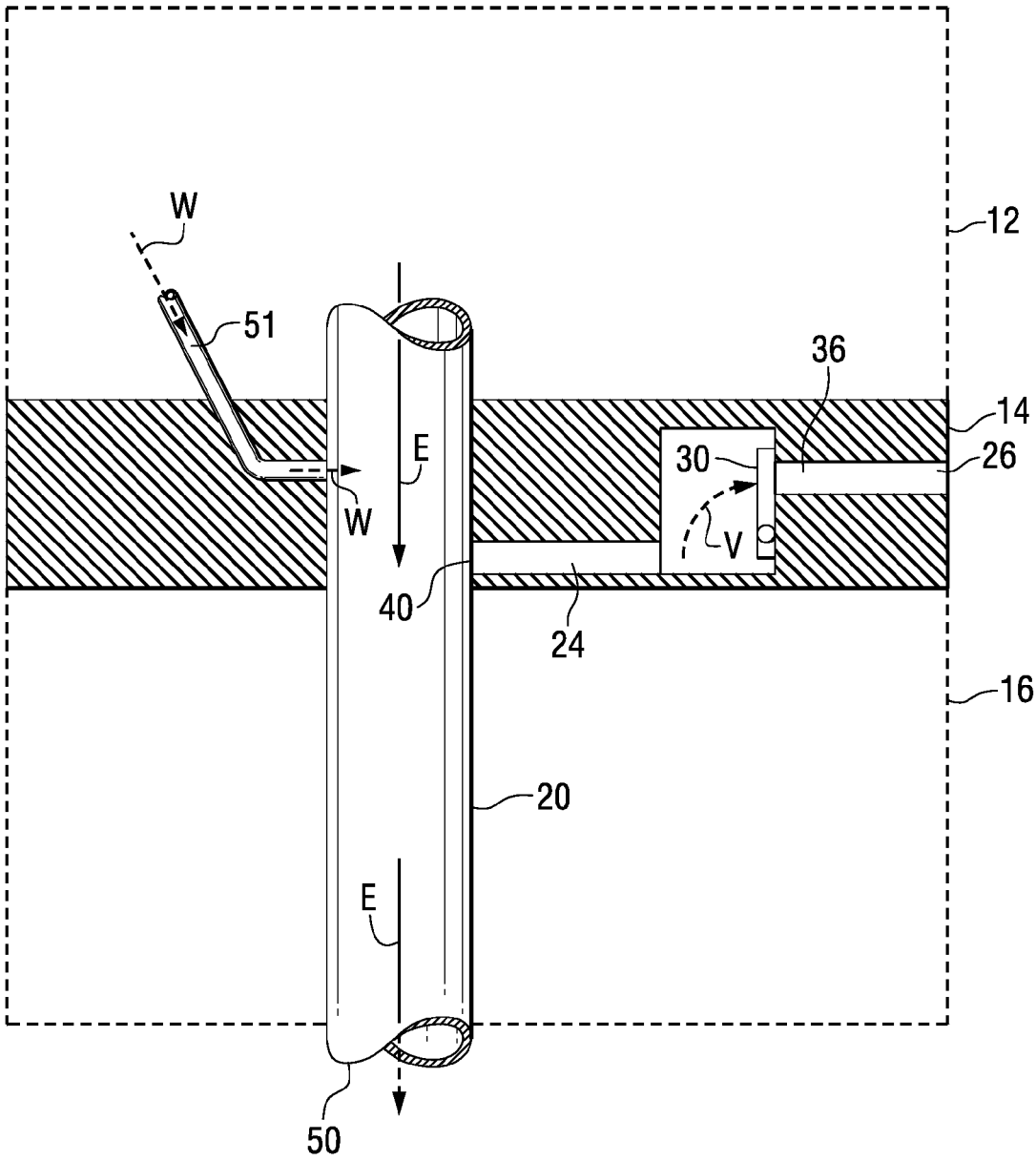
FIG. 2 is generally similar to FIG. 1, but shows the valve in a closed position which inhibits the flow of exhaust gas through the idle exhaust relief passage.

FIG. 2 is generally similar to FIG. 1 except for the fact that it illustrates the operation of the present invention in response to increased exhaust pressure within the exhaust conduit 20 and the portion of the idle exhaust relief path between a connection point 40 and the valve 30. When the pressure upstream from the valve 30 increases beyond a predetermined threshold, the valve 30 closes, as represented by arrow V in FIG. 2, and blocks the flow of exhaust gas through the idle exhaust relief path which is identified by reference numerals 24 and 36. As a result, flow of exhaust gas is inhibited from passing through the opening 26 at the outlet of the idle exhaust gas relief system. The valve is illustrated with a hinge schematically shown where it bends. This has been done merely to identify a flex point location. Many embodiments would use the flexibility of a metal sheet (e.g. a reed valve) to accomplish this motion and would have no hinge.

It should be understood that various different embodiments of the present invention are possible. As an example, the conduit 51, which directs water from the engine 12 to the exhaust conduit 20, is shown in FIGS. 1 and 2 as emitting water W into a location within the adapter plate 14. Alternative embodiments could inject this water at a location much lower with respect to the exhaust conduit 20. As an example, conduit 51 can extend downwardly to a location below the adapter plate 14. Similarly, the connection point 40 between the primary exhaust path of the exhaust conduit 20 and the secondary exhaust path of the idle exhaust relief conduit 24 can be lower than shown in the figures. This connection point 40 can also be below the adapter plate 14, but it is preferable that the water injection location be upstream from the connection point 40.

With continued reference to FIGS. 1 and 2, it can be seen that an outboard motor made in accordance with a preferred embodiment of the present invention comprises an engine 12, a primary exhaust path 20 connected in fluid communication with the engine 12, a secondary exhaust path, 24 and 36, connected in fluid communication with the engine 12, a valve 30 configured to inhibit the flow of exhaust gas through the secondary exhaust path 24 in response to a preselected operating condition of the engine 12, and a water injector 51 connected in fluid communication with the primary exhaust path 20. The secondary exhaust path, 24 and 36, is connected in fluid communication with the primary exhaust path 20 at a connection point 40. The valve 30 is disposed between the connection point 40 and a point 26 of the secondary exhaust path which is at atmospheric pressure. The water injector 51 is connected to the primary path 20 at a location upstream from the connection point 40. In certain embodiments of the present invention, an adapter plate 14 is disposed beneath the engine 12. The valve 30 is a flapper valve disposed within the adapter plate 14 in certain embodiments of the present invention and the preselected operating condition of the engine 12 is the operating speed of the engine to which the valve 30 responds in a preferred embodiment.

Although the present invention has been described with particular specificity and illustrated to show a preferred embodiment, it should be understood that alternative embodiments are also within its scope.

I claim:

1. An outboard motor, comprising:

an engine;

a primary exhaust path connected in fluid communication with said engine;

a secondary exhaust path connected in fluid communication with said engine; and a valve configured to inhibit the flow of exhaust gas through said secondary exhaust path in response to a preselected operating condition of said engine, said preselected operating condition being increasing pressure of exhaust gas emitted from said engine.

2. The outboard motor of claim 1, wherein:

said secondary exhaust path is connected in fluid communication with said primary exhaust path at a connection point.

3. The outboard motor of claim 2, further comprising:

a water injector connected in fluid communication with said primary exhaust path.

4. The outboard motor of claim 3, wherein:

said water injector is connected to said primary exhaust path at a location upstream from said connection point.

5. The outboard motor of claim 2, wherein:

said valve is disposed between said connection point and a point of said secondary exhaust path which is at atmospheric pressure.

6. The outboard motor of claim 1, further comprising:

an adapter plate disposed beneath said engine.

7. The outboard motor of claim 6, wherein:

said valve is disposed within said adapter plate.

8. The outboard motor of claim 1, wherein:

said valve is a flapper valve.

9. An outboard motor, comprising:

an engine;

a primary exhaust path connected in fluid communication with said engine;

a secondary exhaust path connected in fluid communication with said engine, said secondary exhaust path being connected in fluid communication with said primary exhaust path at a connection point; and a valve configured to inhibit the flow of exhaust gas through said secondary exhaust path in response to a preselected operating condition of said engine, said valve being disposed between said connection point and a point of said secondary exhaust path which is at atmospheric pressure, said preselected operating condition being increasing pressure of exhaust gas emitted from said engine, said valve being configured to respond to said pressure being greater than a predetermined threshold by inhibiting said flow of exhaust gas through said secondary exhaust path.

10. The outboard motor of claim 9, further comprising:

a water injector connected in fluid communication with said primary exhaust path, said water injector being connected to said primary exhaust path at a location upstream from said connection point.

11. The outboard motor of claim 10, further comprising:

an adapter plate disposed beneath said engine.

12. The outboard motor of claim 11, wherein:

said valve is disposed within said adapter plate.

13. The outboard motor of claim 11, wherein:

said water injector is disposed within said adapter plate.

14. The outboard motor of claim 9, wherein:

said valve is a flapper valve.

15. The outboard motor of claim 9, wherein:

said preselected operating condition of said engine is the pressure of exhaust gas within the secondary exhaust path caused by the operating speed of said engine.

16. The outboard motor of claim 9, wherein:

said preselected operating condition of said engine is the operating speed of said engine.

17. An outboard motor, comprising:

an engine;

a primary exhaust path connected in fluid communication with said engine;

a secondary exhaust path connected in fluid communication with said engine, said secondary exhaust path being connected in fluid communication with said primary exhaust path at a connection point;

a valve configured to inhibit the flow of exhaust gas through said secondary exhaust path in response to a preselected operating condition of said engine, said valve being disposed between said connection point and a point of said secondary exhaust path which is at atmospheric pressure, said preselected operating condition being increasing pressure of exhaust gas emitted from said engine, said valve being configured to respond to said pressure being greater than a predetermined threshold by inhibiting said flow of exhaust gas through said secondary exhaust path; and a water injector connected in fluid communication with said primary exhaust path, said water injector being connected to said primary exhaust path at a location upstream from said connection point.

18. The outboard motor of claim 17, further comprising:

an adapter plate disposed beneath said engine, said valve being a flapper valve disposed within said adapter plate, said preselected operating condition of said engine being the operating speed of said engine.

* * * * *